US007968780B2

(12) United States Patent
Millender, Jr. et al.

(10) Patent No.: US 7,968,780 B2
(45) Date of Patent: Jun. 28, 2011

(54) METHOD AND APPARATUS FOR OPTIMIZING SOUND OUTPUT CHARACTERISTICS OF A DRUM

(75) Inventors: Samuel Earl Millender, Jr., San Rafael, CA (US); Jesse M. Bradman, Petaluma, CA (US); William 'Billy' L. Johnson, Oakland, CA (US)

(73) Assignee: Riley Investments LLC, Petaluma, CA (US)

( * ) Notice: Subject to any disclaimer, the term of this patent is extended or adjusted under 35 U.S.C. 154(b) by 0 days.

(21) Appl. No.: 12/583,784

(22) Filed: Aug. 26, 2009

(65) Prior Publication Data

US 2010/0037750 A1 Feb. 18, 2010

Related U.S. Application Data

(63) Continuation-in-part of application No. 12/072,867, filed on Feb. 28, 2008, now Pat. No. 7,582,820.

(51) Int. Cl.
*G10D 13/02* (2006.01)

(52) U.S. Cl. ..... 84/411 R

(58) Field of Classification Search ..... 84/411 R
See application file for complete search history.

(56) References Cited

U.S. PATENT DOCUMENTS 494,485 A * 3/1893 Nightingale ..... 84/294
818,289 A * 4/1906 Randall ..... 84/294
2,042,080 A * 5/1936 Turner ..... 84/296
3,181,899 A * 5/1965 McKnight, Jr. ..... 285/139.2
3,289,520 A * 12/1966 Simpson ..... 84/411 R
4,284,166 A * 8/1981 Gale ..... 181/156
4,411,458 A * 10/1983 Strunk et al. ..... 285/196
4,613,169 A * 9/1986 Engelhart ..... 285/139.2
4,742,753 A * 5/1988 Speed ..... 84/414
4,805,514 A * 2/1989 Billings ..... 84/411 M
5,095,796 A * 3/1992 Genna ..... 84/414
D359,958 S * 7/1995 Frodelius ..... D14/208
5,583,307 A * 12/1996 Tobia, Jr. ..... 84/411 R
5,623,132 A * 4/1997 Gahm ..... 181/156
6,677,512 B1 * 1/2004 Chen ..... 84/411 R
6,700,044 B1 * 3/2004 Bencomo, Jr. ..... 84/411 R
6,860,518 B2 * 3/2005 Krauss et al. ..... 285/206
7,011,178 B2 * 3/2006 Morkerken ..... 181/151
7,549,384 B2 * 6/2009 Nagler et al. ..... 114/182
7,560,632 B1 * 7/2009 Lanzel et al. ..... 84/411 R
7,582,820 B2 * 9/2009 Millender et al. ..... 84/411 R
7,659,469 B2 * 2/2010 Belli ..... 84/411 R
7,692,082 B2 * 4/2010 Abe ..... 84/411 R
7,692,083 B2 * 4/2010 Aspland ..... 84/415
7,711,134 B2 * 5/2010 Stead et al. ..... 381/345
7,723,596 B2 * 5/2010 Kelly ..... 84/421
2009/0019985 A1 * 1/2009 Casanta ..... 84/411 R

* cited by examiner

*Primary Examiner* — Elvin G Enad
*Assistant Examiner* — Robert W Horn
(74) *Attorney, Agent, or Firm* — Bruce H Johnsonbaugh

(57) ABSTRACT

An apparatus is provided for maximizing the punch of any double membrane drum and simultaneously minimizing the ringing of the drum. An insert is provided having a body adapted to be slid into an opening formed in either the batter membrane or resonant membrane of the drum. The insert is held in contact with the membrane by one of several mounting techniques. The weight of the insert and the length and width of the body of the insert are sized in a manner to increase the "punch" of the drum and to minimize "ringing" of the drum. The insert may be retrofitted into an existing drum or attached to a batter head membrane or resonant membrane during original manufacture of the drum. The insert may be used with drum openings of any shape by making the cross-sectional shape of the insert conform to the shape of the drum opening.

9 Claims, 12 Drawing Sheets

METHOD AND APPARATUS FOR OPTIMIZING SOUND OUTPUT CHARACTERISTICS OF A DRUM

CROSS-REFERENCE TO RELATED APPLICATION

This application is a continuation-in-part of U.S. application Ser. No. 12/072,867 filed Feb. 28, 2008 now U.S. Pat. No. 7,582,820.

INTRODUCTION AND OVERVIEW OF INVENTION

This application describes improvements to and additional uses for the apparatus shown and described in the parent application, referenced above, which is incorporated herein by reference. More particularly, this application describes and claims improved techniques for mounting the insert to either the resonant membrane or batter head membrane of virtually any double headed drum. This application describes specific additional double headed drums with which the invention may be utilized, namely, floor toms, rack toms, snare drums, marching drums and symphonic drums. In addition, the invention may be used on any double headed drum. The invention may be used in a membrane having an opening of any shape, as described below. It may either be retrofitted into an existing drum or attached to a drumhead (or membrane) during original manufacture of the drum.

Portions of the parent application (slightly modified) are presented below for convenience of the reader.

The present invention pertains generally to techniques for optimizing the sound output of a bass kick-drum and any other double headed (or double membrane) drum as well. The sound output is a factor of the batter head membrane, resonant membrane and space between them, and the resonant characteristics of said components both individually and the interaction of all components combined. As described below, the system of the present invention for the first time adjustably lowers the fundamental resonant frequency of one of the membranes, increases the amplitude of the fundamental resonant frequency which enhances the drum's tonal characteristics, reduces unpleasant or dissonant overtones and undesirable continuation of sound waves, also known as "ringing," by providing an improved dampening feature and dynamically compressing the sound output; all of which are highly desirable improvements over the prior art. Furthermore, the present invention is novel due to its easily removable and portable design in one embodiment, allowing the user the opportunity to use the device by inserting it directly into the resonant chamber through an opening in either the resonant membrane or batter head membrane of the drum without opening the drum. This application describes and claims the use of the insert as applied to an opening in the batter head of a drum as well as to an opening in the resonant membrane.

The present invention, having mass and being coupled to either membrane, increases the mass of the membrane, thereby lowers the membrane's fundamental resonant frequency, and due to its innovative coupling, simultaneously dampens the vibrations known as "ringing," all of which are desirable improvements. Additionally, the invention, constituting a tuned port attached to either membrane and extending into the resonant chamber, furthermore adjustably boosts and enhances the desired frequency characteristics of the drum. Furthermore, the invention momentarily restricts the propagation of the sound wave through the opening in the membrane carrying the insert, and, we believe, adds a sonically warm dynamic compression. The result of the foregoing is increased low frequencies, better definition, clarity, a more consistent sound in varying acoustical environments, and increased dynamic impact.

In a performance or recording environment, an added benefit of mounting the insert on the resonant head (especially in toms, snares, marching drums, etc.) is that a microphone may be placed near the insert, and the microphone at the batter head side can be eliminated so as not to interfere with the drummer's playing zone of various drums described herein. Complexity of tone is much richer near the insert; by so placing the microphone, the front or resonant membrane can also be heard very well as sound comes through the insert in the resonant membrane.

BACKGROUND

Description of Invention

The output sound of a drum is inherently much more difficult to optimize than that of a simple string. A vibrating string used in all string instruments is a one dimensional body that vibrates in a second dimension. A vibrating string produces harmonic, pleasant sounding overtones that are integral multiples of the fundamental frequency of the string. "Tuning" or "adjusting the pitch" of the string's fundamental frequency is a simple matter of loosening or tightening the string tension.

In contrast to the vibrating string, a circular drum membrane is a two dimensional body that vibrates in a complex fashion described by Bessel function equations in a third dimension. A drum cannot be "tuned" like a vibrating string. As described below, the subject invention allows the user to "tune" or adjust the desired fundamental resonant frequency while concurrently minimizing the undesirable overtones known as "ringing."

When either membrane of a two membrane drum is struck, the other membrane vibrates and the vibrations include the desired fundamental resonant frequency along with non-harmonic, unpleasant and/or dissonant ringing overtones. These unpleasant overtones are inherent in any circular drum membrane and cannot be removed or reduced by simply adjusting the resonant drumhead tension. The primary dissonant overtone is approximately 2.4 times the fundamental frequency of the drumhead membrane, regardless of the tension applied to the membrane. The above-described dissonant overtones are also produced in all drums having two drumheads—the resonant and batter head membranes.

If the resonant or batter head membrane is allowed to vibrate in an undampened manner, we believe the dissonant undesirable frequency continues which is not only noticeable, but actually interferes with the next sound wave and likely often subsequent sound waves produced when the batter head membrane is hit with a drumstick or other implement. We also believe that "ringing" moreover occurs as a result of the combination of the inherent, dissonant overtones and an undampened vibration of either membrane. The present invention minimizes "ringing" by quickly dampening the vibration of both membranes.

It is desirable to increase what the percussion industry commonly describes as the "punch" of the drum sound output. As used herein and in the claims, the word "punch" is defined to include the following three features: (1) the lowering of the fundamental resonant frequency of the membrane carrying the insert, (2) increasing the amplitude of the fundamental resonant frequency, and (3) increasing the damping of the membrane carrying the insert, which reduces undesirable continuation of tone which interferes with subsequent sound waves. These three features can be scientifically measured as described in the parent application. In addition to these three measurable features, we believe the invention dynamically compresses the sound output via restriction of sound waves in their exit from the resonant chamber through either membrane.

Lowering the fundamental frequency of either the batter or resonant membrane produces a deeper, fuller sound output which is one of the elements of "punch." As is known from Bessel function equations, the fundamental resonant frequency of a circular drum membrane is governed by three variables. The first variable is the diameter of the membrane—the greater the diameter, the lower the fundamental resonant frequency. The second variable is the mass of the vibrating membrane—the greater the mass, the lower the fundamental resonant frequency. The third variable is the tension applied to the drumhead membrane—the greater the tension, the higher the fundamental resonant frequency.

The present invention provides a novel method and apparatus for lowering the fundamental resonant frequency of any double headed drum such as (without limitation) bass drums, snare drums, floor tom drums and rack tom drums. The drummer is now, for the first time, able to easily maximize the "punch" of the drum by adjustably lowering the fundamental resonant frequency. By adding "mass" or "weight" to an insert described below, the user can adjustably lower the fundamental resonant frequency of either membrane.

Additionally, the design of the present invention constitutes a "tuned port" which when inserted provides a novel method of increasing the amplitude of fundamental resonant frequencies of the membrane carrying the insert.

A primary object of the invention is to simultaneously maximize the punch and minimize "ringing" in double headed drums.

A further object of the invention is to provide a novel insert constituting a "tuned port" for a double headed drum which simultaneously and adjustably increases the amplitude of the desired fundamental resonant frequency permitting the user to "tune" the sound output while preserving the natural and original acoustic qualities of the drum.

A further object of the invention is to provide a novel insert which through the momentary restriction of sound waves in their exit from the resonant chamber, we believe, dynamically compresses the output, which results in a more consistent sound in varying acoustical environments.

A further object of the invention is to provide a novel insert that focuses sound out of the resonant chamber into a microphone.

A further object is to provide a method for adjustably optimizing the output sound of dual headed drums by maximizing the "punch" and simultaneously minimizing the "ringing" of virtually any double membrane drum.

Another object is to provide an insert easily inserted through a circular (or other shape) opening in either membrane, and having adjustment means for setting the tension between the insert and the membrane to which it is attached.

A final object of the invention is to provide a novel insert that offers a clean, powerful and purposeful aesthetically pleasing look rather than industry standard five inch resonant drum hole opening.

Other objects and advantages will become apparent from the following description of the drawings.

BRIEF DESCRIPTION OF THE DRAWINGS

FIG. 7 illustrates a floor tom drum;

FIG. 8 illustrates a snare drum;

FIG. 9 illustrates a concert base drum;

FIG. 10 illustrates a marching snare drum;

FIG. 11 illustrates a marching bass drum; and

FIG. 12 illustrates a rack tom drum.

DETAILED DESCRIPTION OF THE DRAWINGS

Figure 1:
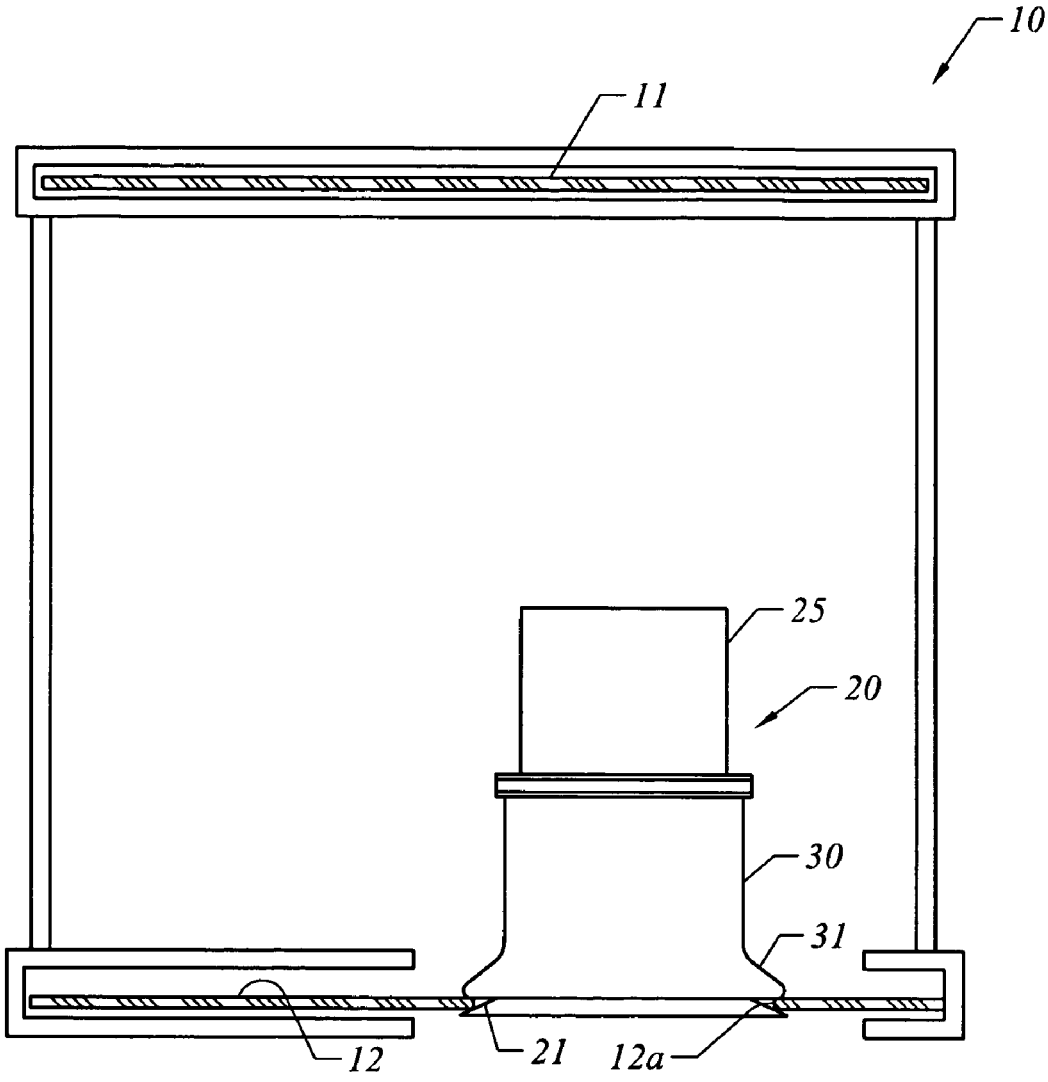
FIG. 1 is a schematic representation of a first embodiment showing the insert mounted in the resonant membrane.

FIG. 1 is a schematic drawing of a first embodiment of the invention. A drum shown generally as 10 includes two circular membranes 11 and 12. Drum 10 may be a bass drum, marching drum, symphonic drum, snare drum, floor tom drum or rack tom drum; that is, drum 10 may be any double headed or double membrane drum. Membrane 11 is commonly referred to as the batter head membrane and is struck by a beater, drumstick or other implement (not shown). The second membrane 12 is commonly referred to as the drum head or resonant membrane and typically has a circular opening 12*a* formed in membrane 12 as is known in the prior art. Opening 12*a*, as is known in the art, is provided to help optimize the sound output of the drum 10. Opening 12*a* is shown as circular, but it could be any shape, such as oval, triangular, rectangular, etc.

According to the present invention, a novel removable insert 20 is simply slid into opening 12*a* of membrane 12. Insert 20 includes a cylindrical body 25 which in one embodiment carries a flexible sleeve 30, preferably made out of rubber. Cylindrical body 25 has a peripheral flange 21 at its outer end. Sleeve 30 has a peripheral flange 31 at its outer end (the end adjacent the membrane 12 which carries insert 20). The insert has a cross-sectional shape that conforms to the shape of the opening 12*a*; if the opening 12*a* is square, the insert will have a square cross-section.

Figure 2:
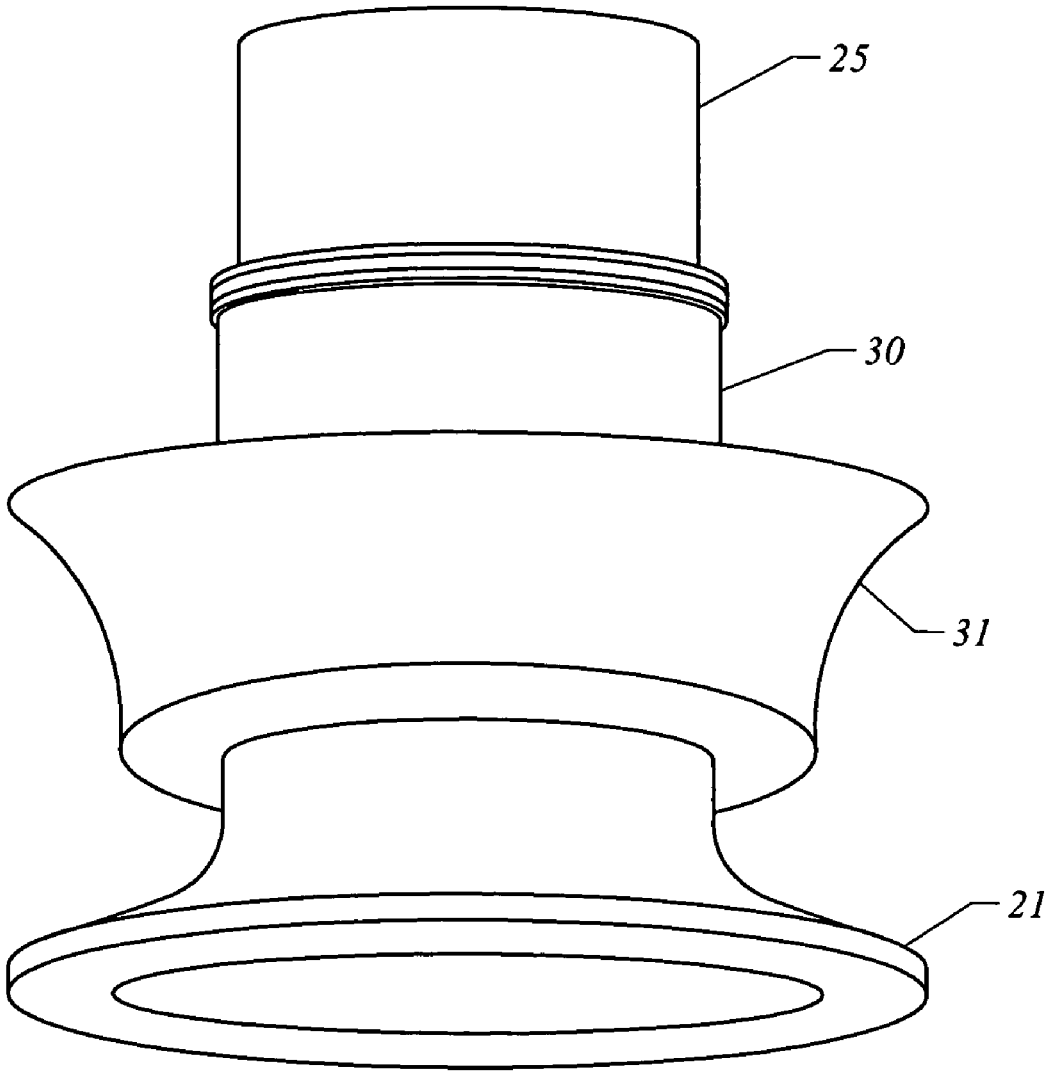
FIG. 2 is an illustration of the insert shown in FIG. 1 illustrating the retracted position of the rubber sleeve.

As shown in FIG. 2, flexible sleeve 30 has a first retracted position wherein the peripheral flange 31 is folded back away from flange 21 to allow the sleeve 30 to pass through the circular opening 12*a* in resonant membrane 12. Sleeve 30 has a second, expanded position shown in FIG. 1 wherein the peripheral flange 31 is fully extended away from cylindrical body 25 and contacts resonant membrane 12. The user simply reaches through cylindrical body 25 with a screwdriver or small stick to move flange 31 into contact with membrane 12. The peripheral flanges 21 and 31 contact membrane 12 from both sides.

The weight of the insert and the length and diameter (or width) of the body of the insert are sized to maximize the punch of the drum and to simultaneously minimize the ringing of the drum. The sizing of the weight, length and diameter (or width) is discussed in greater detail in the parent application and is not repeated here in the interest of brevity. The weight and the length and diameter (or width) of the insert are essentially reduced in size as the size of the drum into which the insert is placed is reduced.

Figure 3:
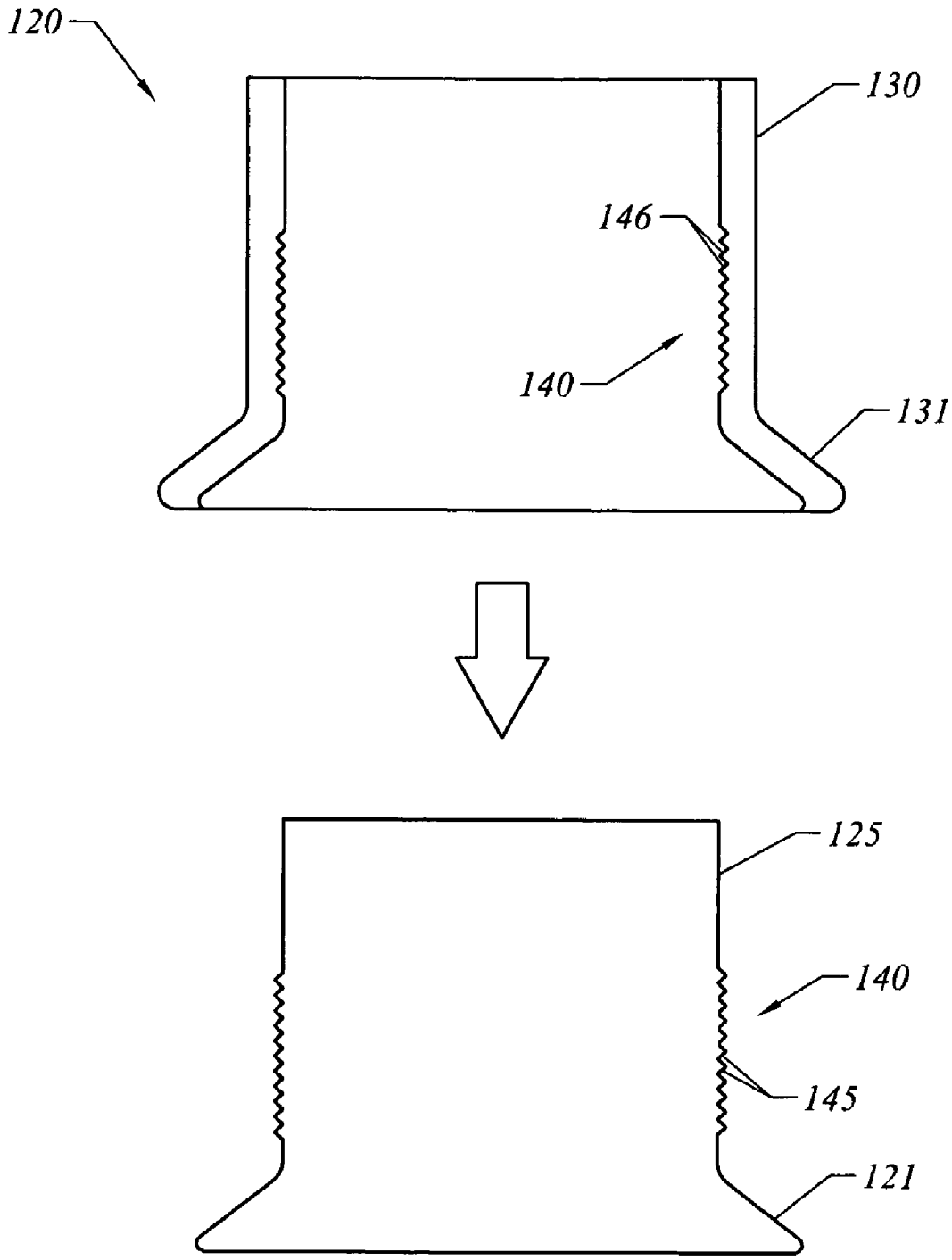
FIG. 3 is a schematic illustration of an alternate insert utilizing a threaded flexible sleeve.

FIG. 3 shows another embodiment of insert 120 in which the flexible sleeve 130 is carried by the cylindrical body 125 by adjustable carrying means 140 which is preferably a series of threads 145 on cylindrical body 125 and threads 146 on flexible sleeve 130. This threaded connection allows the user to rotate either cylindrical body 125 or sleeve 130 to adjust the tension between sleeve 130 and membrane 12.

Figure 4:
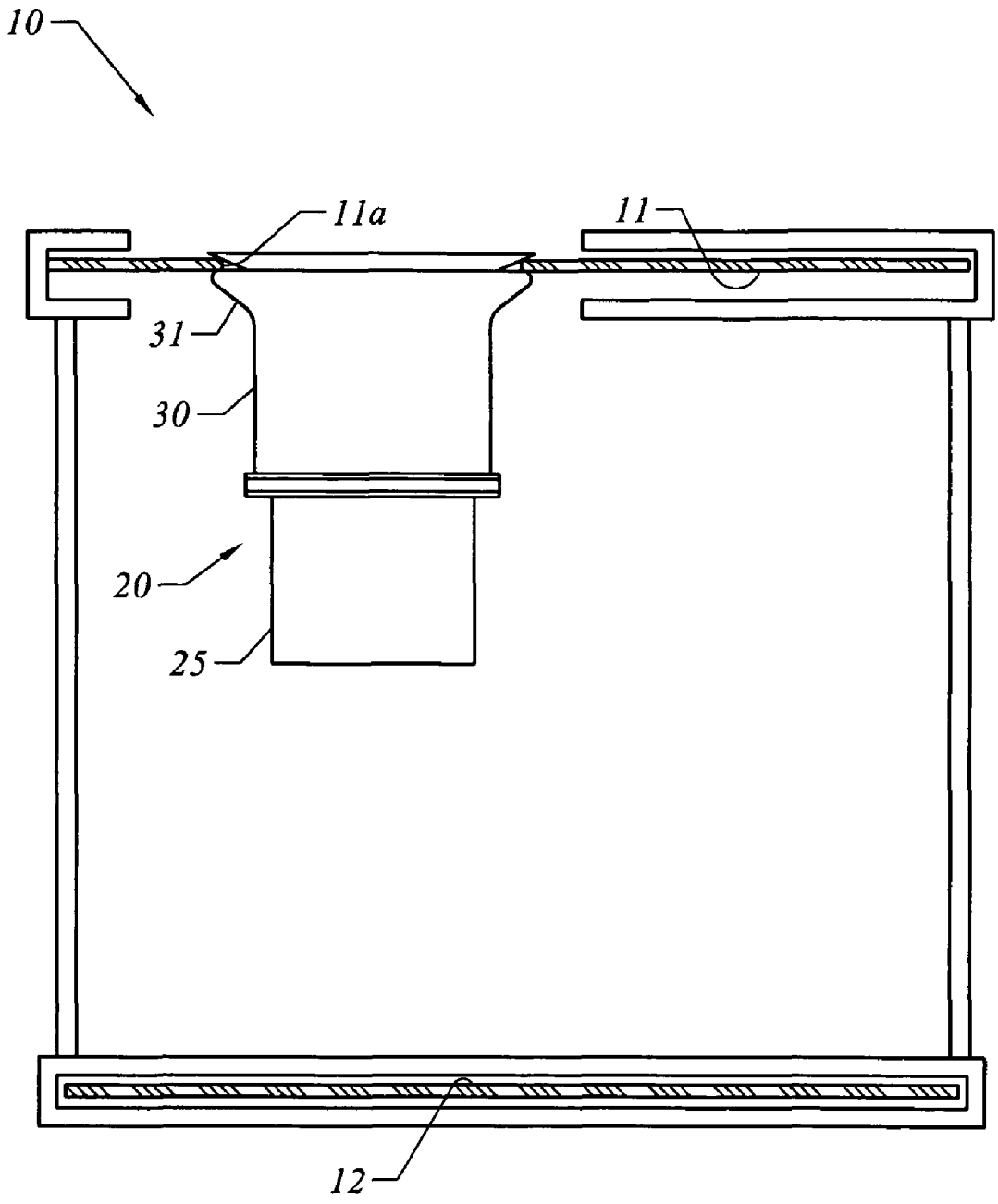
FIG. 4 illustrates a further embodiment of the invention wherein the insert is carried in the batter head membrane rather than in the resonant membrane.

FIG. 4 illustrates a further embodiment of the invention wherein the insert 20 is carried by an opening 11*a* formed in the batter head membrane 11 of drum 10 rather than in the resonant membrane 12 as shown in FIG. 1.

Figure 5:
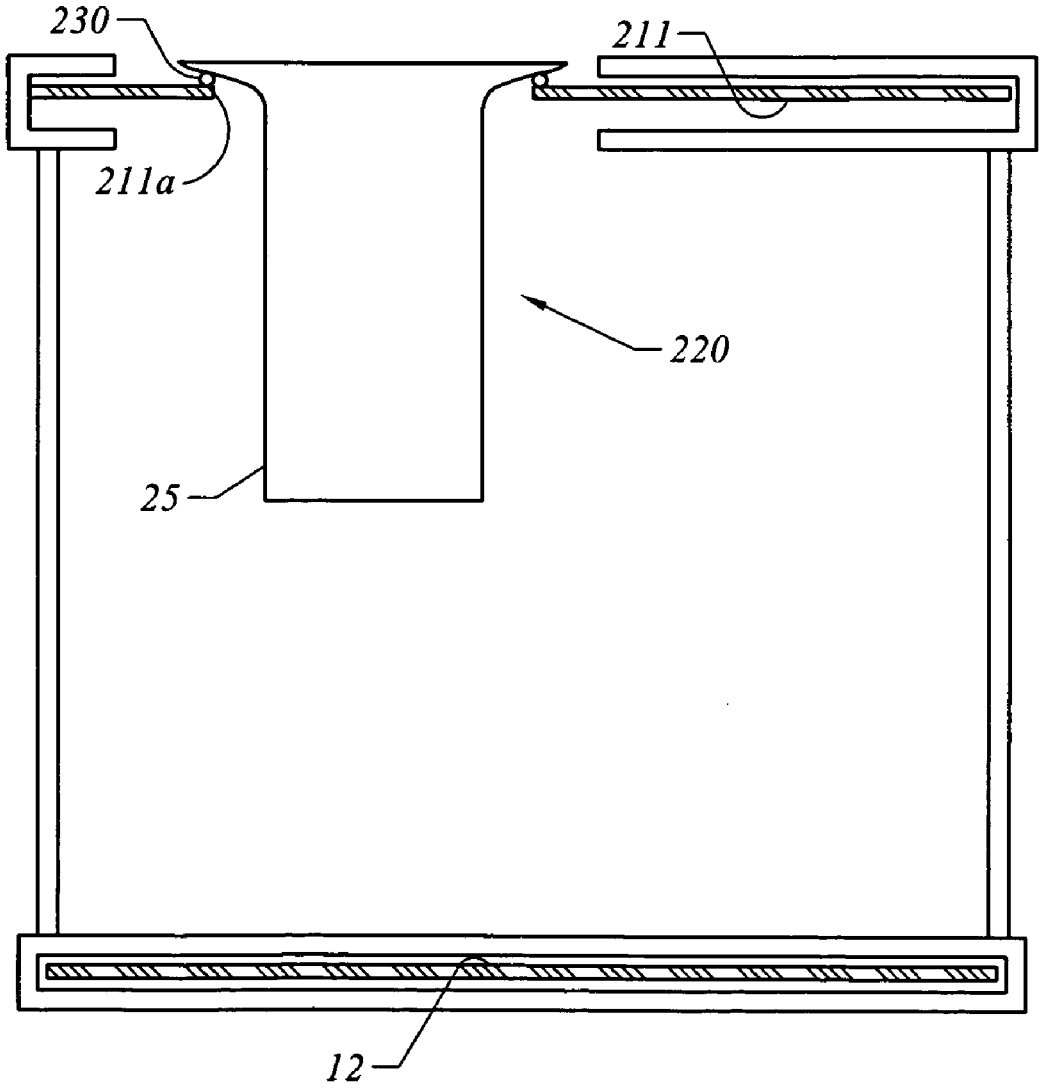
FIG. 5 illustrates a further embodiment of the invention wherein the cylindrical (or other shape) insert is mounted to the batter head membrane by a bead of adhesive material.

FIG. 5 illustrates a further embodiment of the invention wherein the insert 220 is carried by opening 211*a* formed in batter head membrane 211. In this embodiment, the mounting means for insert 220 is an adhesive bead 230 between membrane 211 and peripheral flange 221 of insert 220. No flexible sleeve is required.

Figure 6:
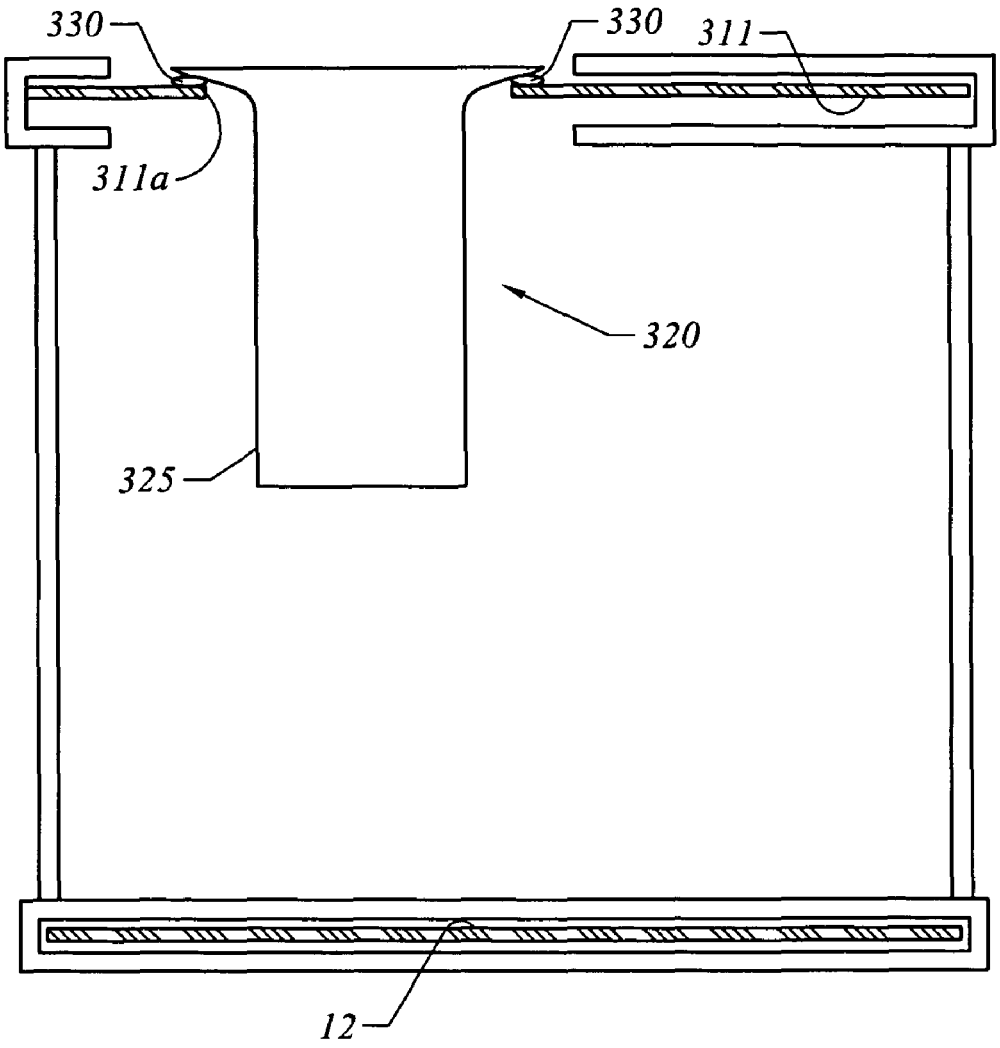
FIG. 6 illustrates a further embodiment wherein the mounting means used to attach the insert is either Velcro or double sided adhesive tape.

FIG. 6 illustrates a further embodiment of the invention wherein the insert 320 is mounted to batter head membrane 311 by mounting means 330 which may be either Velcro or double sided adhesive tape. An optional foam ring (not shown for clarity) may be placed around the body 325 next to mounting means 330 to prevent vibration.

The insert of the invention may be utilized in drum openings of any shape, including circular, oval, diamond and rectangular shapes without limitation. The cross-section of the body of the insert conforms to the shape of the opening so that the body is adapted to be slid into the opening.

The insert of the invention may be attached or mounted to either the batter head membrane or resonant membrane during original manufacture of the drum. The attachment or mounting may be permanent or removable.

FIGS. 7-12 illustrate additional examples of double membrane drums in which the insert of the present invention may be utilized. FIGS. 7-12 do not illustrate the insert of the invention. They are simply examples of alternate drums to which the invention may be applied.

Figure 7:
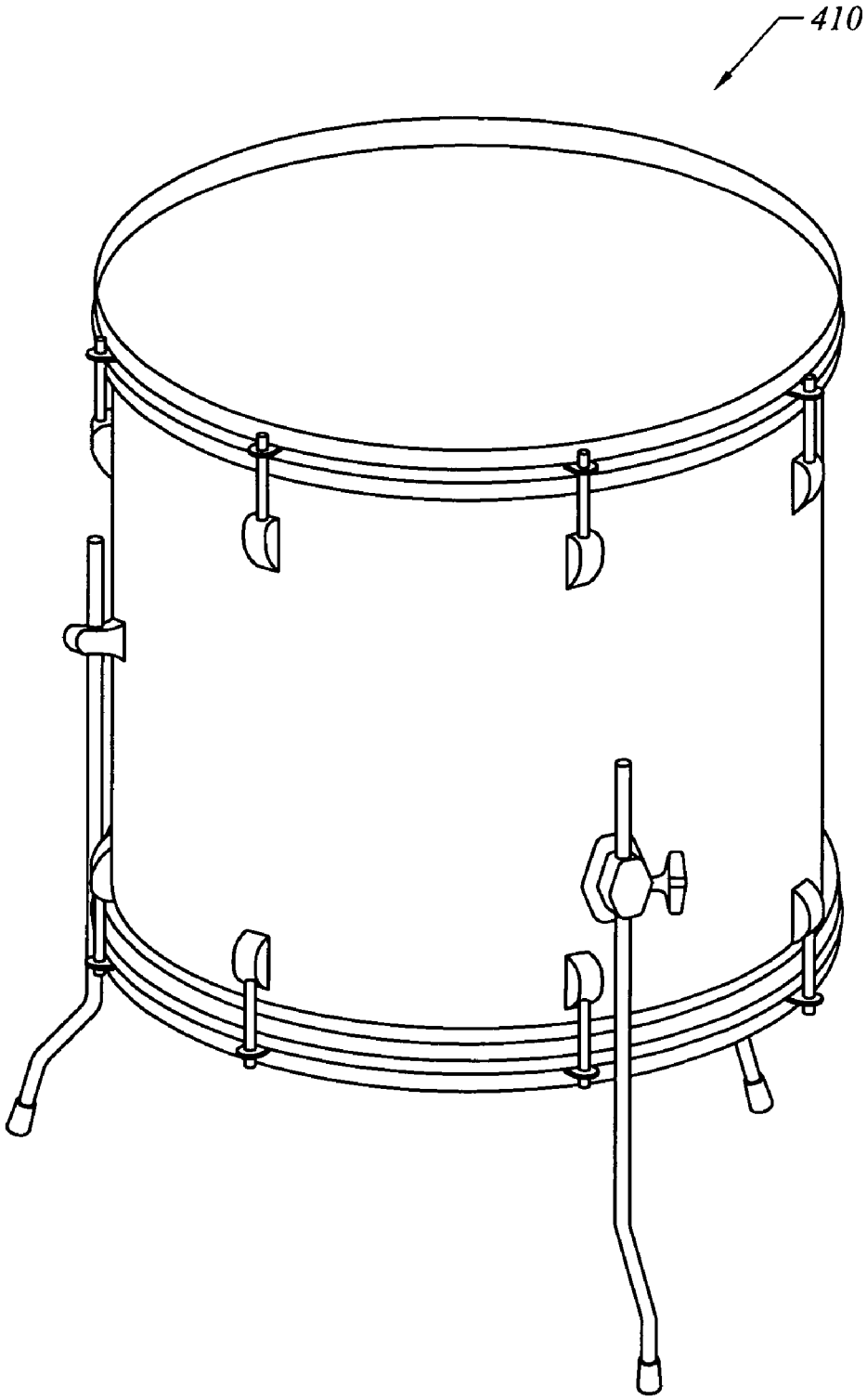
FIG. 7 (Prior Art)
FIGS. 7-12 illustrate examples of drums in which the invention may be utilized.

FIG. 7 illustrates a floor tom drum 410.

Figure 8:
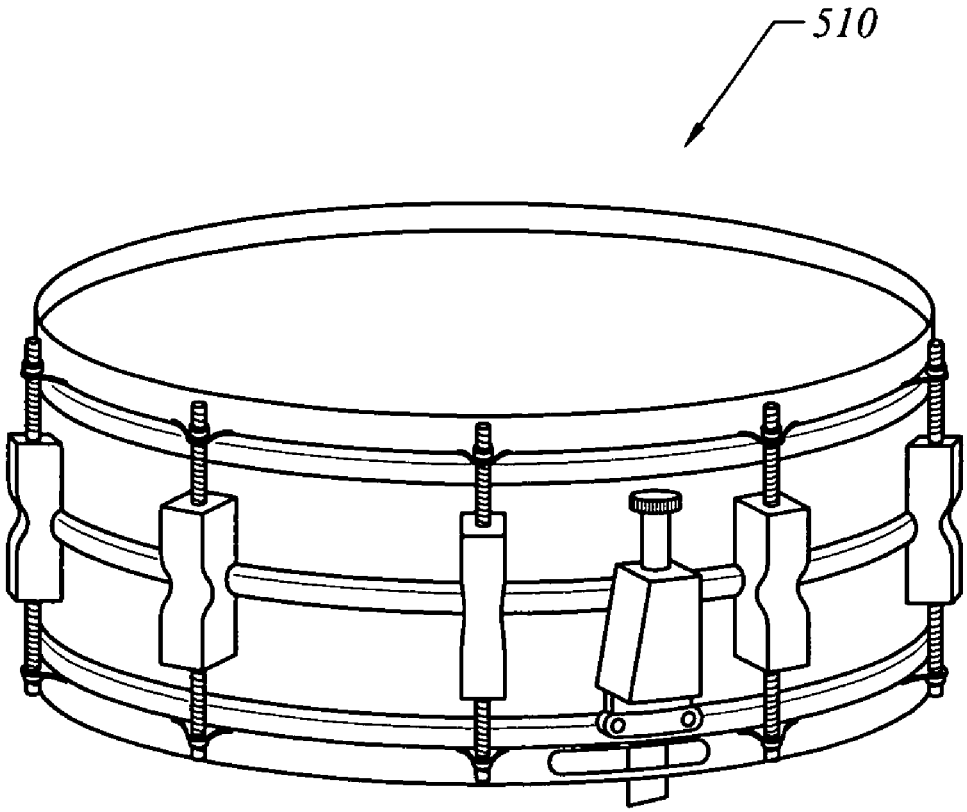
FIG. 8 (Prior Art)

FIG. 8 illustrates a snare drum 510.

Figure 9:
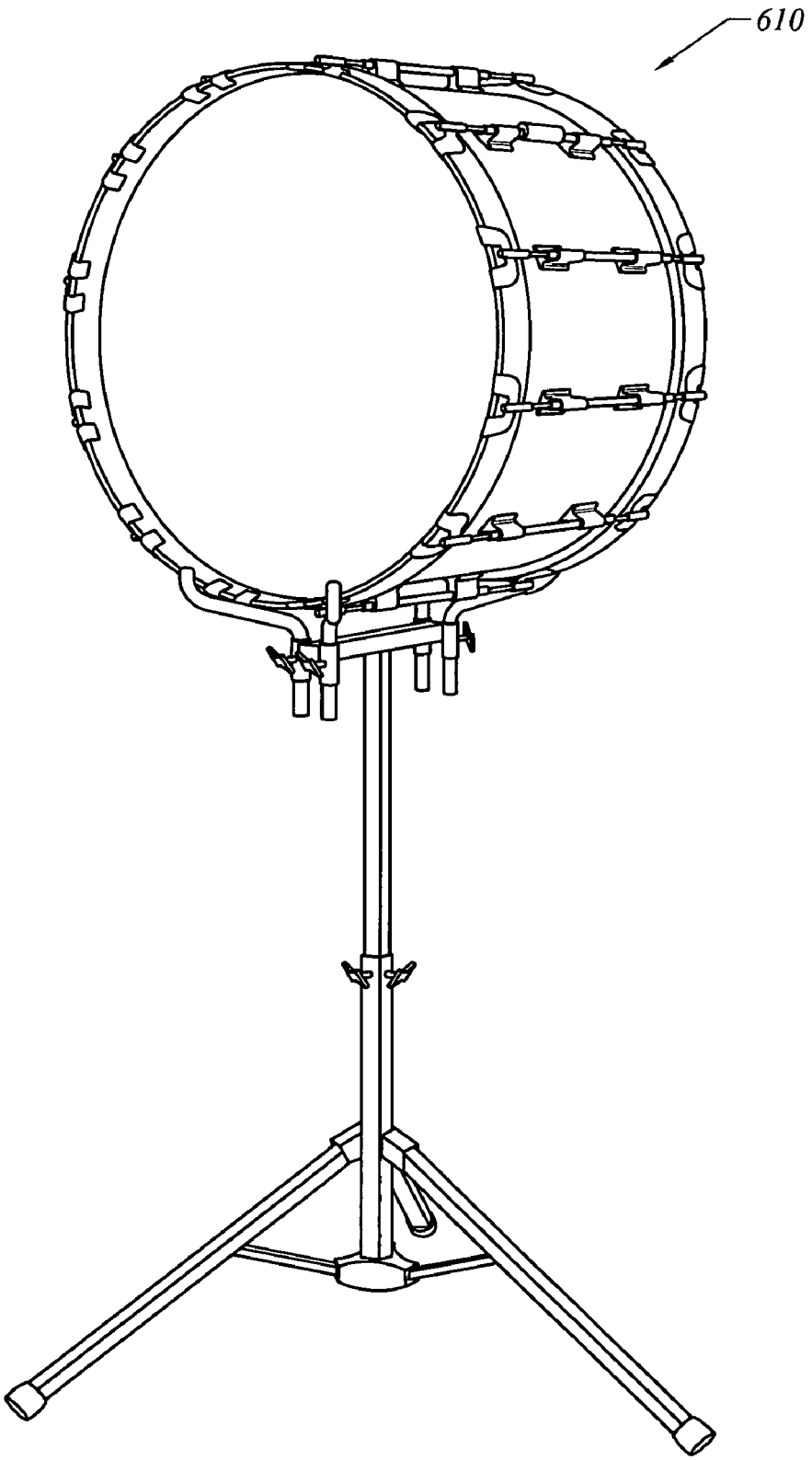
FIG. 9 (Prior Art)

FIG. 9 illustrates a concert bass drum 610.

Figure 10:
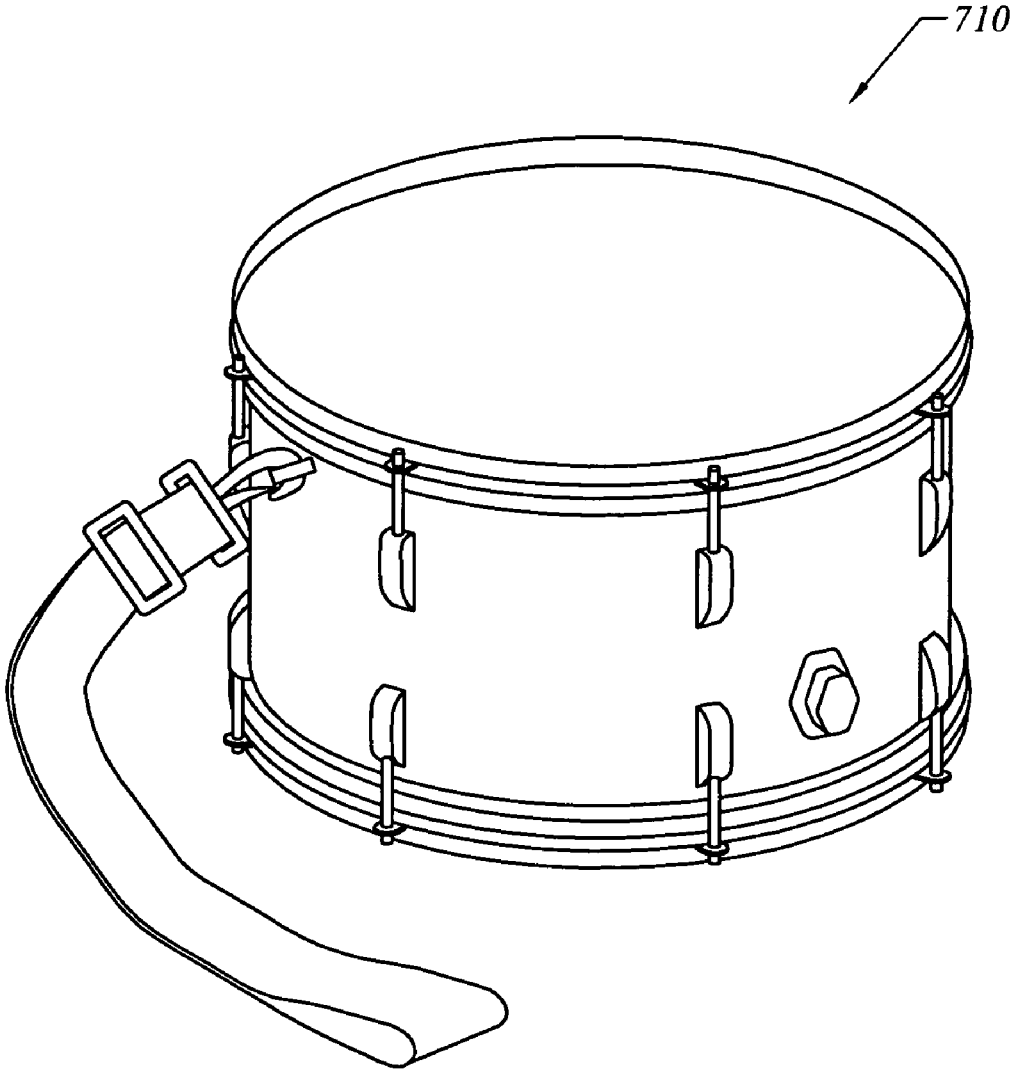
FIG. 10 (Prior Art)

FIG. 10 illustrates a marching snare drum 710.

Figure 11:
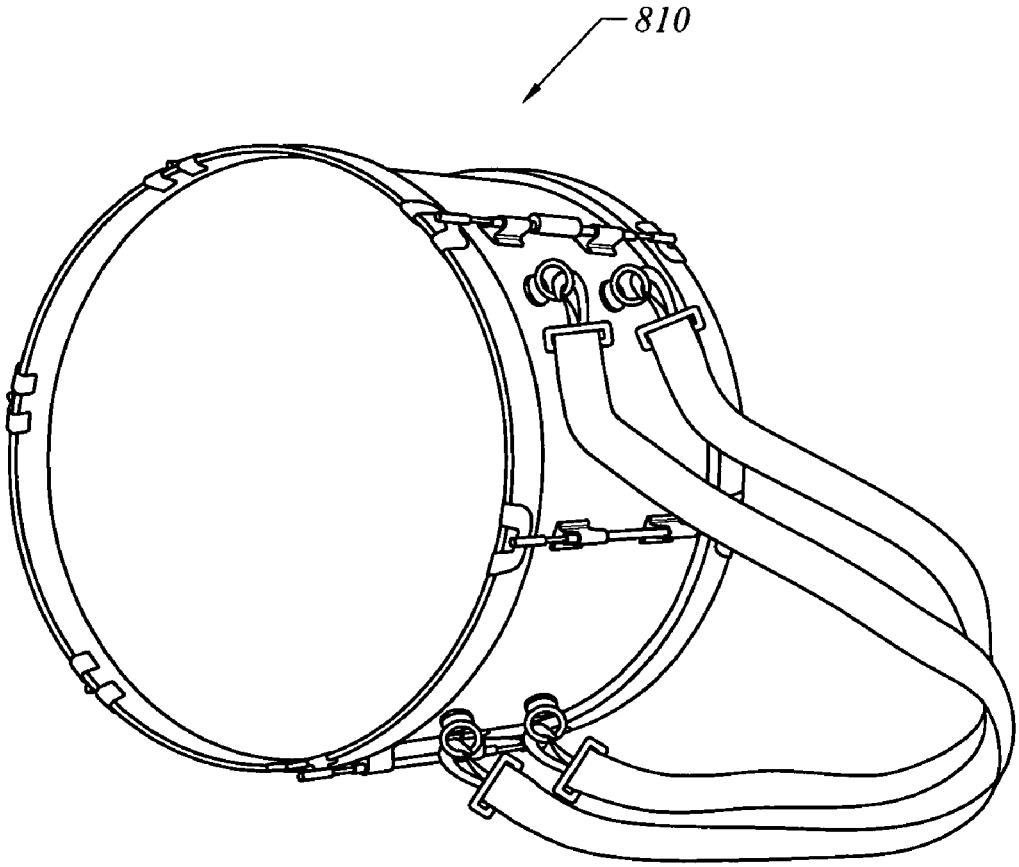
FIG. 11 (Prior Art)

FIG. 11 illustrates a marching bass drum 810.

Figure 12:
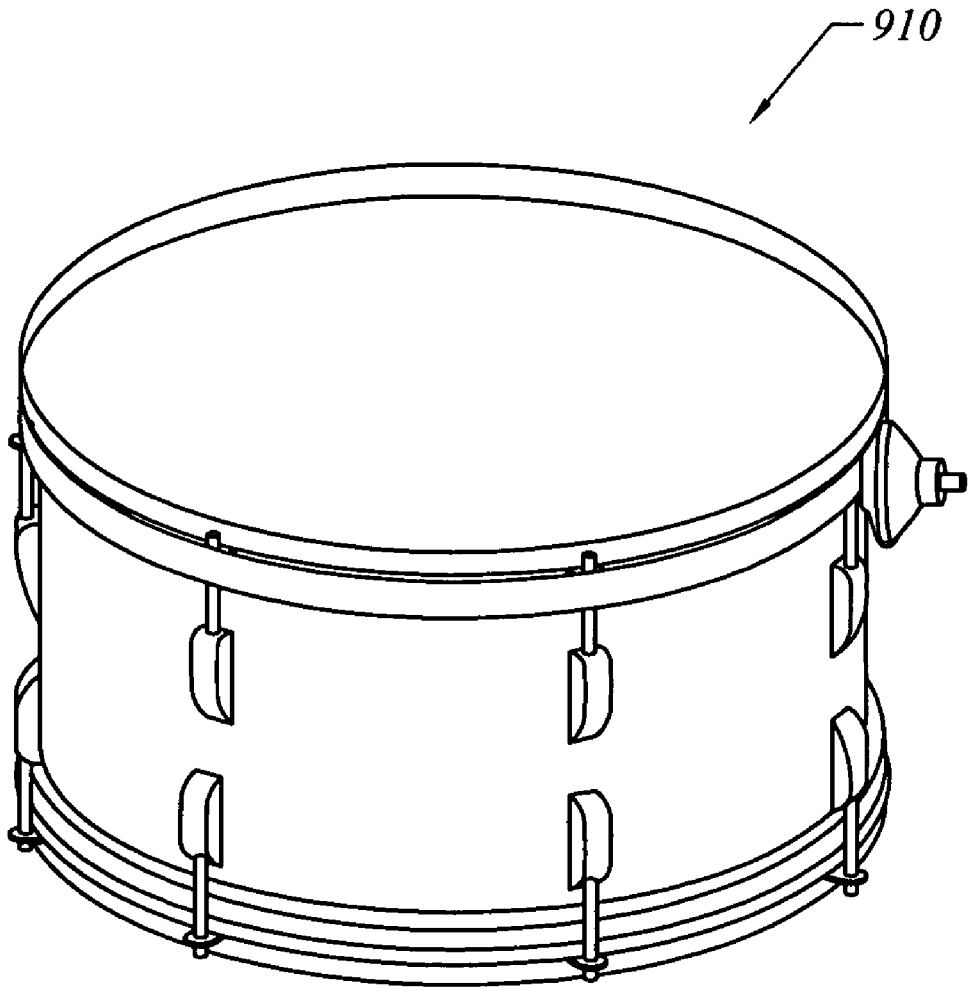
FIG. 12 (Prior Art)

FIG. 12 illustrates a rack tom drum 910.

A detailed description of the operation of the insert and the manner in which it affects the output of the drum is not provided here for the sake of brevity. A full description of that interaction is given in the parent application.

The foregoing description of the invention has been presented for purposes of illustration and description and is not intended to be exhaustive or to limit the invention to the precise form disclosed. Modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. An apparatus for maximizing the punch of a double headed drum and simultaneously minimizing the ringing of said drum, wherein said drum has a batter head membrane, a resonant membrane and an opening formed in one of said membranes, comprising:

an insert, said insert having a body, said body having a length and width to occupy a volume, and having a uniform cross-section over said length that conforms to said opening, and being adapted to be slid into said opening in one of said membranes, and mounting means for connecting said insert to said one membrane, wherein the weight of said insert and the length and cross section of said insert are sized to maximize the punch of said drum and to simultaneously minimize the ringing of said drum.

2. The apparatus of claim 1 wherein said body is cylindrical and said insert includes a flange at the outer end of said body.

3. The apparatus of claim 2 wherein said mounting means is a flexible sleeve carried by said body, wherein said flexible sleeve is movable between a first, retracted position wherein said sleeve is able to pass through said opening in said one membrane, and a second, expanded position wherein said sleeve extends away from said body and contacts said one membrane.

4. The apparatus of claim 3 further comprising adjustable carrying means for connecting said flexible sleeve to said body.

5. The apparatus of claim 4 wherein said adjustable carrying means is a threaded connection between said flexible sleeve and said cylindrical body.

6. The apparatus of claim 2 wherein said mounting means is adhesive applied between said flange portion of said body and said one membrane carrying said insert.

7. The apparatus of claim 2 wherein said mounting means is Velcro applied between said flange portion of said body and said one membrane carrying said insert.

8. The apparatus of claim 2 wherein said mounting means is double sided adhesive tape applied between said flange portion of said body and said one membrane carrying said insert.

9. The apparatus of claim 1 wherein said insert is connected to said one membrane during original manufacture of said drum.

* * * * *